US010350722B2

(12) United States Patent
Omagari et al.

(10) Patent No.: US 10,350,722 B2
(45) Date of Patent: Jul. 16, 2019

(54) POLISHING APPARATUS

(71) Applicant: TOSHIBA KIKAI KABUSHIKI KAISHA, Tokyo-To (JP)

(72) Inventors: Hiroaki Omagari, Shizuoka-Ken (JP); Masateru Tomiyasu, Shizuoka-Ken (JP); Yu Murofushi, Shizuoka-Ken (JP)

(73) Assignee: TOSHIBA KIKAI KABUSHIKI KAISHA, Tokyo-To (JP)

( * ) Notice: Subject to any disclaimer, the term of this patent is extended or adjusted under 35 U.S.C. 154(b) by 0 days.

(21) Appl. No.: 15/422,652

(22) Filed: Feb. 2, 2017

(65) Prior Publication Data

US 2017/0225288 A1 Aug. 10, 2017

(30) Foreign Application Priority Data

Feb. 5, 2016 (JP) ..... 2016-021315
Dec. 27, 2016 (JP) ..... 2016-254137

(51) Int. Cl.
*B24B 37/005* (2012.01)
*B24B 37/30* (2012.01)
*B24B 37/20* (2012.01)

(52) U.S. Cl.
CPC ..... *B24B 37/005* (2013.01); *B24B 37/20* (2013.01); *B24B 37/30* (2013.01)

(58) Field of Classification Search
CPC ..... B24B 37/005; B24B 37/20; B24B 37/30
See application file for complete search history.

(56) References Cited

U.S. PATENT DOCUMENTS 5,908,530 A * 6/1999 Hoshizaki ..... B24B 7/241 156/345.14
8,250,720 B2 * 8/2012 Tomioka ..... B24B 39/04 29/90.01
2016/0256976 A1 * 9/2016 Shinozaki ..... B24B 37/005
2016/0368115 A1 * 12/2016 Yasuda ..... B24B 37/32
2017/0047237 A1 * 2/2017 Kobata ..... H01L 22/26
2017/0225287 A1 * 8/2017 Murofushi ..... B24B 37/005

FOREIGN PATENT DOCUMENTS

JP S59-219152 12/1984
JP 05-057606 3/1993
JP 05-57606 A * 3/1993
JP 2003-094328 4/2003
(Continued)

OTHER PUBLICATIONS

JP 2013-233651 A—Nov. 2013—English Machine Translation.*
(Continued)

*Primary Examiner* — Marc Carlson
(74) *Attorney, Agent, or Firm* — DLA Piper LLP US

(57) ABSTRACT

A polishing apparatus includes: a holding section that holds a material to be polished; a polishing body that polishes the material to be polished held by the holding section; a head that supports the polishing body via an elastic mechanism; a driving mechanism that causes the head to be moved in a Z coordinate direction; a control unit that controls the driving mechanism; and a position sensor that measures a position of the polishing body with respect to the head. The load control is performed based on a measurement value of the position sensor and a spring constant value of the elastic mechanism.

6 Claims, 5 Drawing Sheets

(56) References Cited

FOREIGN PATENT DOCUMENTS

| | | | | |
|---|---|---|---|---|
| JP | 2003-326456 | | | 11/2003 |
| JP | 2005-514780 | | | 5/2005 |
| JP | 2007-181895 | | | 7/2007 |
| JP | 2008-290173 | | | 12/2008 |
| JP | 2013-233651 | | | 11/2013 |
| JP | 2013233651 | A | * | 11/2013 |
| JP | 2015-036165 | | | 2/2015 |
| KR | 1999-0014896 | | | 2/1999 |
| KR | 2001-0054603 | | | 7/2001 |
| KR | 20010054603 | A | * | 7/2001 |
| WO | WO 2013/038573 | | | 3/2013 |

OTHER PUBLICATIONS

JPH 05-57606 A—Mar. 1993—English Machine Translation.*
Taiwanese Office Action issued in Taiwanese Application No. 106103734 dated Oct. 17, 2017, with English language translation.
Taiwanese Office Action issued in Taiwanese Application No. 106103725 dated Oct. 17, 2017, with English language translation.
English Language Abstract and Translation of JP S59-219152 published Dec. 10, 1984.
English Language Abstract of JP 2003-094328 published Apr. 3, 2003.
English Language Abstract and Translation of JP 2003-326456 published Nov. 18, 2003.
English Language Abstract and Translation of JP 2005-514780 published May 19, 2005.
English Language Abstract and Translation of JP 2007-181895 published Jul. 19, 2007.
English Language Abstract and Translation of JP 2015-036165 published Feb. 23, 2015.
Korean Office Action issued in KR 10-2017-0015604 dated Feb. 26, 2018.
Korean Office Action issued in KR 10-2017-0015607 dated Mar. 21, 2018.
English Language Abstract of KR 2001-0054603 published Jul. 2, 2001.
English Language Abstract of KR 1999-0014896 published Feb. 25, 1999.
English Language Abstract of JP 05-057606 published Nov. 18, 2003.
U.S. Appl. No. 15/422,646 dated Jan. 10, 2019.
Partial Image File Wrapper of Related U.S. Appl. No. 15/422,646 electronically captured from PAIR dated May 20, 2019.

* cited by examiner

POLISHING APPARATUS

CROSS-REFERENCE TO RELATED APPLICATIONS

This application is based upon and claims the benefit of priority from Japanese Patent Application No. 2016-021315, filed on Feb. 5, 2016 and Japanese Patent Application No. 2016-254137, filed on Dec. 27, 2016; the entire contents of which are incorporated herein by reference.

BACKGROUND OF THE INVENTION

Field of the Invention

The present invention relates to a polishing apparatus.

Background Art

Conventionally, a polishing apparatus that uses a polishing pad, which is rotationally driven, as disclosed in WO 2013/038573, for example, has been known as a polishing apparatus that polishes a surface of a wafer made of a semiconductor material, and the like. In general, the polishing pad is provided at a distal end of a rotation shaft. The polishing pad including a rotation mechanism and a rotation shaft is supported by a head via an elastic mechanism. The head is supported by an apparatus main body via a driving mechanism.

It is possible to employ a method of combining position control and load control, as disclosed in JP S59-219152 A, for example, as a method of controlling a driving mechanism. This control method is a method in which the driving mechanism is controlled based on a position (coordinate) of a polishing pad (the position control) until achieving a target load when polishing is performed by the polishing pad in contact with a wafer, and the driving mechanism is controlled based on pressure caused on a contact surface between the polishing pad and the wafer (the load control) after achieving the target load. A position (Z coordinate) of a head when achieving the target load at the time of the polishing is determined based on the area of a polishing surface of the polishing pad and a spring constant value of an elastic mechanism.

It is possible to measure a load applied to the polishing pad using a load cell provided above the rotation shaft of the polishing pad, for example. The measurement procedure is as follows. That is, the head is lowered (moved in a direction of approaching the wafer) along a Z coordinate axis (vertical axis), and the polishing surface of the polishing pad is pushed against the wafer. Along with this, the elastic mechanism (coil spring) is deformed, and the polishing pad and the rotation shaft are relatively moved upward with respect to the head. Accordingly, a strain gauge inside the load cell is deformed as an upper end portion of the rotation shaft is pushed to the load cell, and a force of the upper end portion of the rotation shaft pushing the strain gauge is measured. Further, a Z coordinate value of the head is adjusted such that the force to be measured by the load cell becomes the target load.

In the polishing apparatus described above, the polishing pad is rapidly moved upward (pushed up), and a measurement value of the load cell rapidly increases when a polishing body passes through a location where a tiny protrusion and a foreign substance is present at the time of performing the load control. In general, it is difficult to perform the highly accurate load control in accordance with such a rapid change of the load. In addition, a measurable load range is relatively narrow in the highly accurate load cell, and thus, there is a risk that it is difficult to perform proper measurement of the load.

SUMMARY OF THE INVENTION

The inventors of the present application have found out that it is possible to expand the measurable load range and to perform polishing processing at high accuracy even when a rapid change of the load occurs by performing load control based on a position sensor (for example, a linear scale) and on a spring constant value of an elastic mechanism, as a result of diligently repeating studies.

The invention has been made based on the above-described findings. That is, an object of the invention is to provide a polishing apparatus capable of expanding a detection range of a load applied to a polishing body and maintaining highly accurate polishing processing even when the polishing body passes through a location where a tiny protrusion or a foreign substance is present.

An embodiment of the invention is a polishing apparatus including: a holding section that holds a material to be polished; a polishing body that polishes the material to be polished held by the holding section; a head that supports the polishing body via an elastic mechanism; a driving mechanism that causes the head to be relatively moved in a direction in which a separation distance from the material to be polished is changed, with respect to the material to be polished; and a control unit that is connected to the driving mechanism and controls the driving mechanism, wherein the elastic mechanism provides an elastic force in a direction of canceling a load of the head.

According to the invention, the load applied to the polishing body is measured without using a load cell or the like, and thus, it is possible to provide the polishing apparatus capable of expanding the detection range of the load and maintaining the highly accurate polishing processing even when the polishing body passes through the location where the tiny protrusion or the foreign substance is present.

The polishing apparatus may include a position sensor which is connected to the control unit and which measures a position of the polishing body with respect to the head. In this case, it is possible to accurately measure a relative position of the polishing body with respect to the head.

The position sensor may be a linear scale. In this case, it is easy to accurately measure a relative position of the polishing body with respect to the head.

The control unit may be configured to calculate a load applied to the polishing body based on a measurement value of the position sensor and a spring constant value of the elastic mechanism, and control the load. In this case, it is possible to accurately control the position of the polishing body.

According to the invention, the load applied to the polishing body is not directly measured by the load cell or the like, and thus, it is possible to provide the polishing apparatus capable of expanding the detection range of the load and maintaining the highly accurate polishing processing even when the polishing body passes through the location where the tiny protrusion or the foreign substance is present.

DETAILED DESCRIPTION OF THE INVENTION

Hereinafter, an embodiment of the invention will be described in detail with reference to the accompanying drawings.

Figure 1:
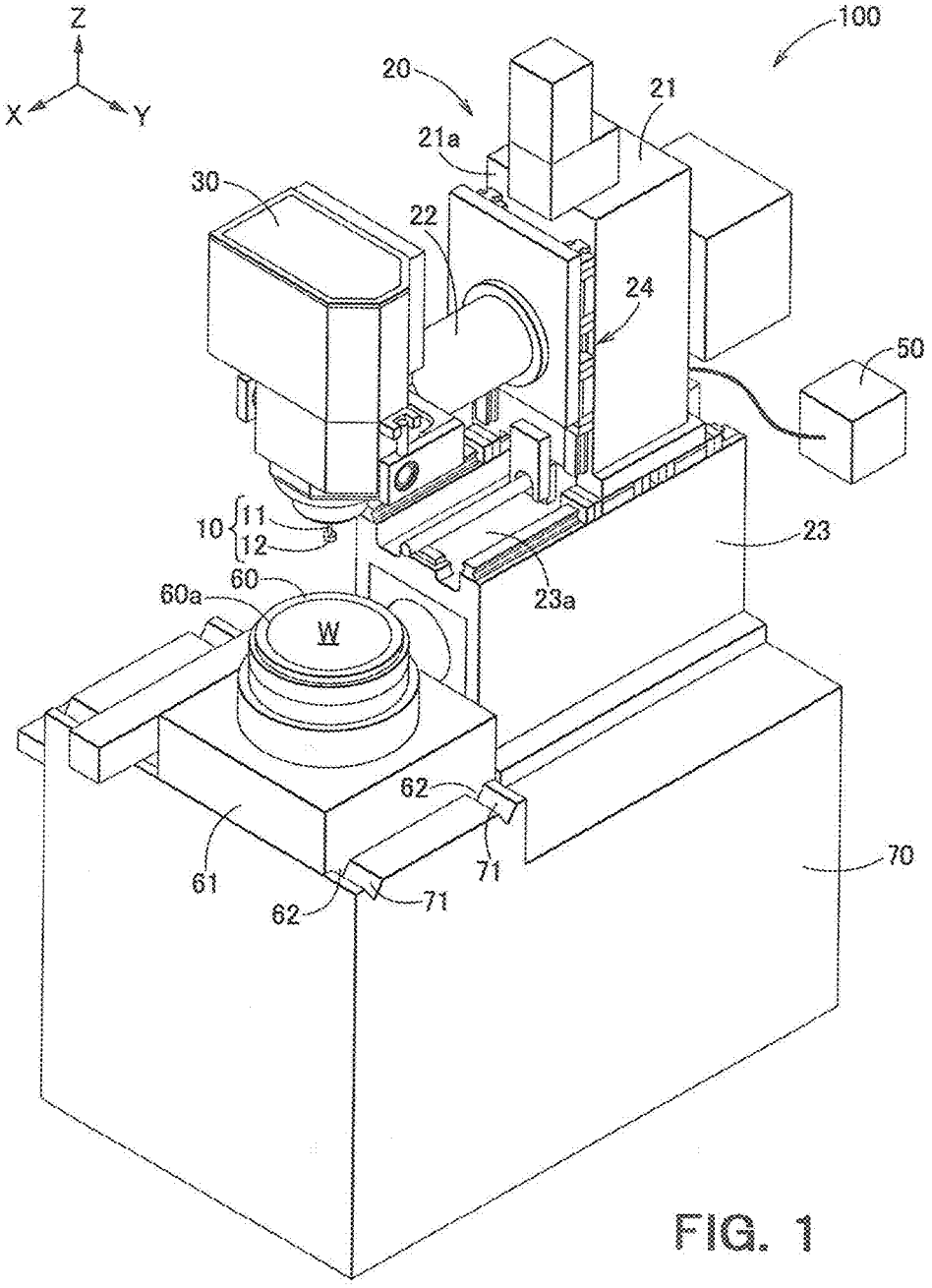
FIG. 1 is a schematic perspective view illustrating a polishing apparatus according to an embodiment of the invention.

FIG. 1 is a schematic perspective view illustrating a polishing apparatus 100 according to an embodiment of the invention. As illustrated in FIG. 1, the polishing apparatus 100 according to this embodiment includes: a bed 70; a table 60 which is provided on the bed 70 and serves as a holding section that holds a material to be polished (wafer Wa); a polishing body 10 that polishes the material to be polished held by the table 60; a head 30 that supports the polishing body 10 via an elastic mechanism 32 (see FIG. 2); a driving mechanism 24 that causes the head 30 to be moved in a Z coordinate direction (up-and-down direction in FIG. 1) with respect to apparatus main body 20; and a control device 50, as a control unit, that is connected to the driving mechanism 24 and controls the driving mechanism 24.

Among them, the table (holding section) 60 is configured to hold the discoid wafer Wa serving as the material to be polished. The table 60 is supported by a cuboid support block 61 which is arranged on the bed 70.

In addition, the polishing body 10 polishes the wafer Wa held by the table 60. As illustrated in FIG. 1, the polishing body 10 includes a spindle 11 and a polishing pad 12 attached to one end portion (lower end portion in FIG. 1) of the spindle 11. A discoid shape with a diameter of 10 mm is employed as the polishing pad 12 according to this embodiment.

The apparatus main body 20 according to this embodiment is configured to support the head 30 via the driving mechanism 24 that causes the head 30 to be relatively moved with respect to the wafer Wa. As illustrated in FIG. 1, the apparatus main body 20 includes a cuboid column 21, a cylindrical arm 22 whose one end is supported on one side surface 21*a* of the column 21 via the driving mechanism 24, and a cuboid base 23 which supports the column 21 at an upper surface 23*a*. The head 30 is attached to the other end of the arm 22. It is configured such that the arm 22 is moved on the one side surface 21*a* of the column 21 in a vertical direction (Z coordinate direction of FIG. 1) by the driving mechanism 24. Accordingly, positioning of the head 30 in the Z coordinate direction is performed.

In addition, it is configured such that the column 21 according to this embodiment is moved on the base 23 in a length direction of the arm 22 (an X coordinate direction of FIG. 1) by the existing driving mechanism. Accordingly, positioning of the head 30 in the X coordinate direction is performed.

In addition, the bed 70 is configured to support the support block 61 of the table 60 and the apparatus main body as illustrated in FIG. 1. To be specific, the table 60 and the support block 61 are arranged on an upper surface of the bed 70 at a position that corresponds to the polishing body 10. In this embodiment, ridges 62 to be engaged with two parallel grooves 71, carved on the bed 70 along a Y coordinate direction of FIG. 1, are provided on a lower surface of the support block 61, and the support block 61 is capable of moving along the two parallel grooves 71. Accordingly, positioning of the table 60 in the Y coordinate direction, that is, positioning of the head 30 in the Y coordinate direction with respect to the table 60 is performed. The table 60 according to this embodiment includes a mounting surface 60*a* whose diameter is, for example, 200 mm.

Figure 2:
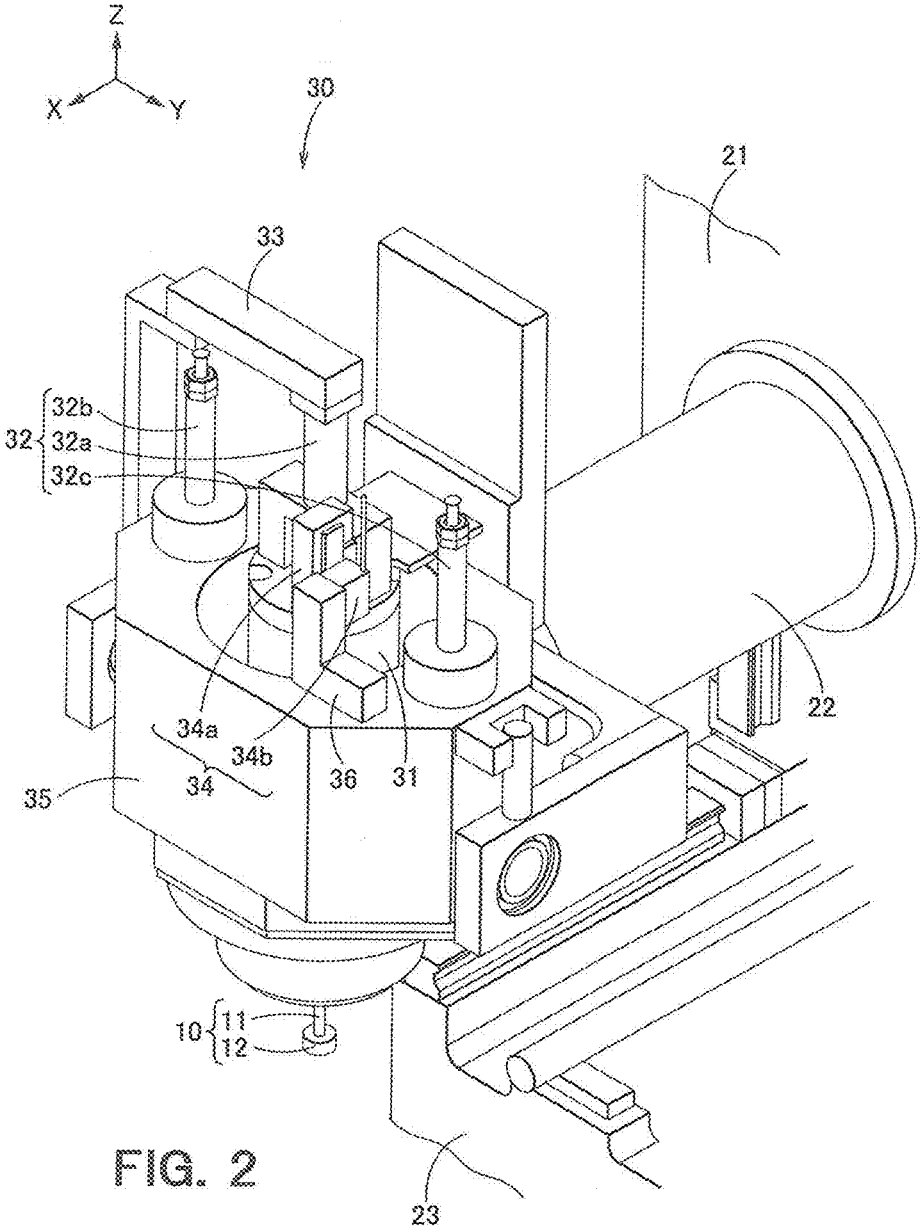
FIG. 2 is a schematic perspective view illustrating an internal structure of a head of the polishing apparatus illustrated in FIG. 1.
Figure 3:
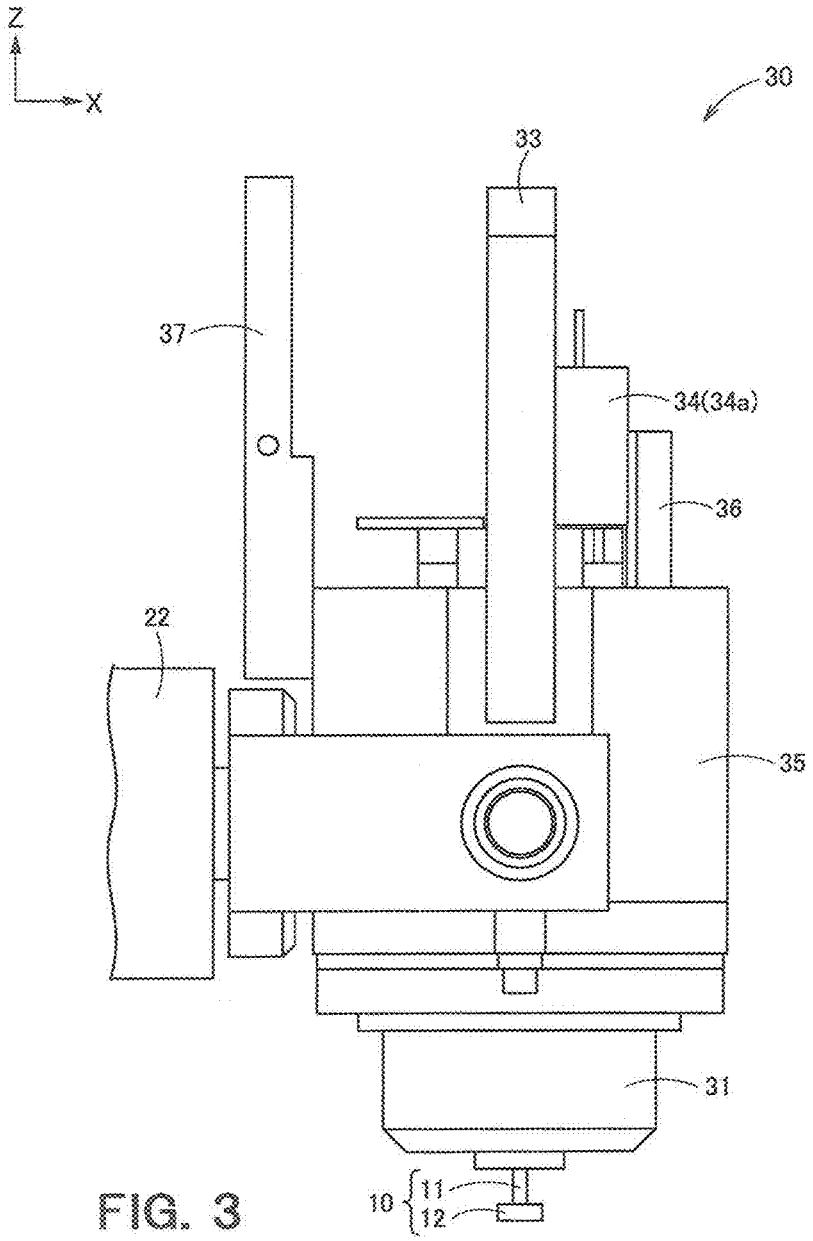
FIG. 3 is a schematic side view in a case where the head of the polishing apparatus illustrate in FIG. 1 is viewed from the upper left of FIG. 2.

Next, a configuration of the head 30 will be further described. FIG. 2 is a schematic perspective view illustrating an internal structure of the head 30 of the polishing apparatus 100 illustrated in FIG. 1; FIG. 3 is a schematic side view in a case where the head 30 of the polishing apparatus 100 illustrated in FIG. 1 is viewed from the upper left of FIG. 2; and FIG. 4 is a schematic cross-sectional view of the head 30 of FIG. 3 in a plane that passes through a shaft center of the spindle 11 in parallel to the paper surface of FIG. 3.

Figure 4:
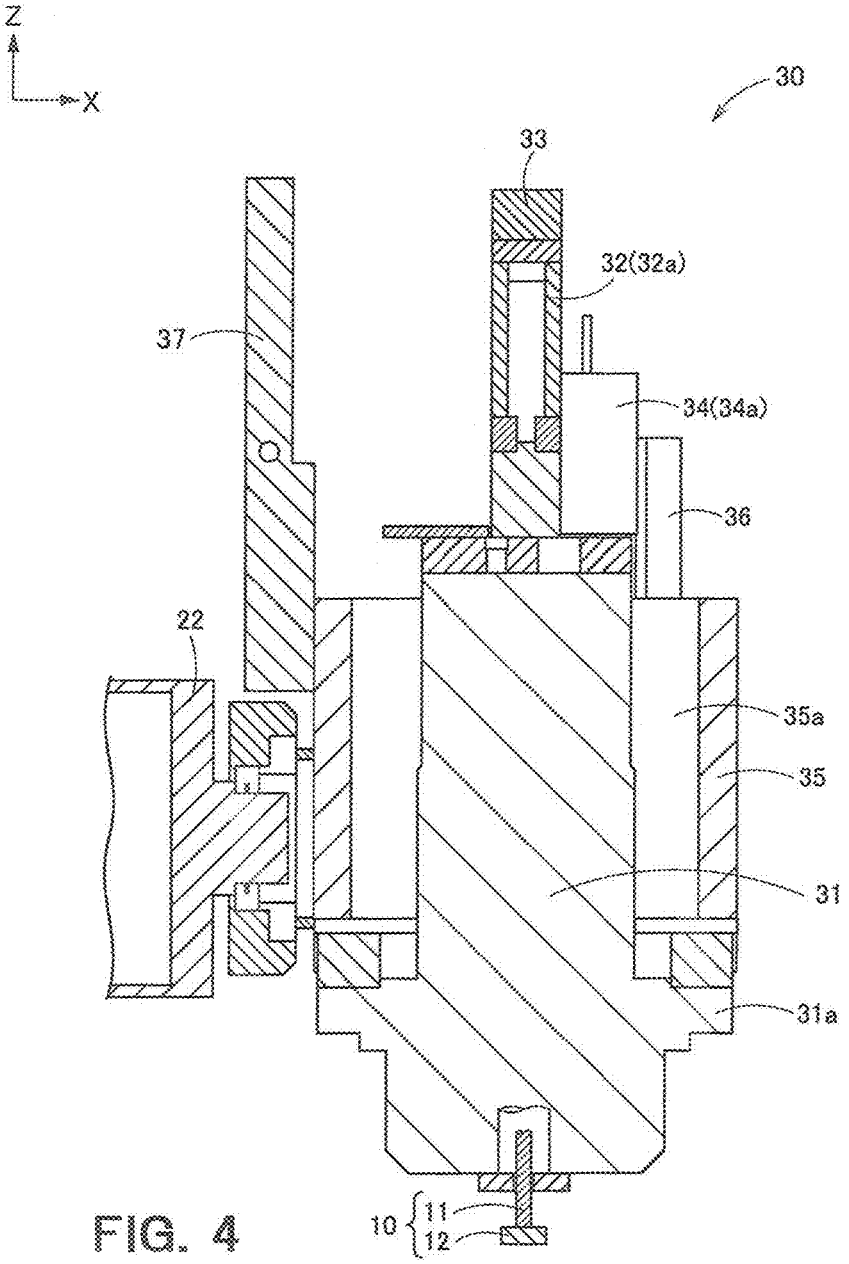
FIG. 4 is a schematic cross-sectional view of the head of FIG. 3 in a plane that passes through a shaft center of a spindle in parallel to the paper surface of FIG. 3.

As illustrated in FIGS. 2 to 4, the head 30 according to this embodiment is configured to support the polishing body 10. This head 30 includes a polishing body support member 31 that is supported via the elastic mechanism 32 and supports the spindle 11 of the polishing body 10. The existing driving mechanism (not illustrated), which causes the spindle 11 to be rotatably driven, is provided inside the polishing body support member 31 so as to rotate the polishing body 10 at desired rotational speed. As illustrated in FIG. 4, the polishing body support member 31 is formed in a cylindrical shape which has a flange portion 31*a* on a side surface thereof, and a cover 35 that is fixed to the arm 22 and surrounds the polishing body support member 31 is provided above the flange portion 31*a*. An outer shape of the cover 35 is an octagonal prism as illustrated in FIG. 2. A through-hole 35*a* is formed in the cover 35 in the up-and-down direction, and the polishing body support member 31 is capable of moving in the up-and-down direction inside the through-hole 35*a*.

In addition, the elastic mechanism 32 according to this embodiment is configured of one pressing spring 32*a*, which presses the polishing body 10 downward together with the polishing body support member 31, and two balancing springs 32*b* and 32*c* to support the own weight of the polishing body support member 31 as illustrated in FIG. 2. The pressing spring 32*a* is provided at the upper end of the polishing body support member 31, and is configured to generate a resilient force along the shaft center of the spindle 11 of the polishing body 10. In addition, the balancing springs 32*b* and 32*c* are provided on an upper surface of the cover 35 at both sides of the pressing spring 32*a* in a Y-axis direction to be parallel with the pressing spring 32*a*. In this embodiment, the upper end of the pressing spring 32*a* is connected to a support body 33 such that a load applied to the polishing body 10 is measured via the pressing spring 32*a*.

Further, the polishing apparatus 100 includes a linear scale 34 as a position sensor that measures a coordinate (W coordinate in FIG. 2) of the polishing body 10 in the vertical direction with respect to the head 30. As illustrated in FIG. 2, the linear scale 34 includes a stator 34*a* which is fixed to an upper end of the polishing body support member 31 and a mover 34*b* which is fixed above the cover 35 via the support member 36. The linear scale 34 is configured to measure a relative position of the polishing body support member 31 with respect to the cover 35. Further, the control device 50 is configured to evaluate the position (W coordinate) of the polishing body 10 with respect to the head 30 based on this measurement value.

Figure 5:
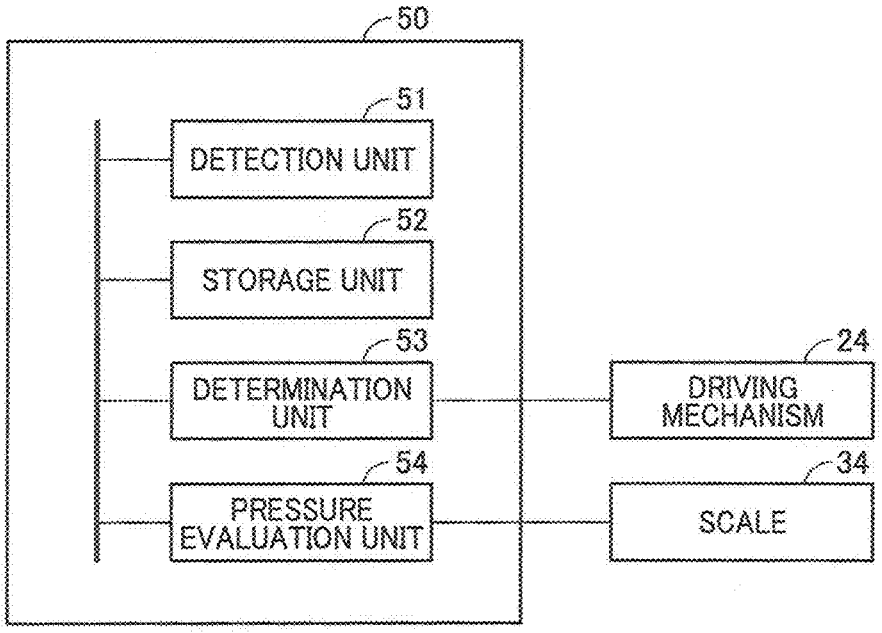
FIG. 5 is a block diagram schematically illustrating a control device of the polishing apparatus illustrated in FIG. 1.

FIG. 5 is a schematic block diagram of the control device 50 that is connected to the polishing apparatus 100 illustrated in FIG. 1. As illustrated in FIG. 5, the control device 50 according to this embodiment includes: a detection unit 51 that detects a relative position relationship between the shaft center of the spindle 11 of the polishing body 10 and a rotation center of the table 60; a storage unit 52 that stores a Z coordinate of the polishing body support member 31 when position control is switched to load control; a determination unit 53 that determines whether the polishing body support member 31 reaches the Z coordinate; and a pressure evaluation unit 54 that evaluates a contact area between the polishing pad 12 and the wafer Wa based on the relative position relationship between the shaft center of the spindle 11 of the polishing body and the rotation center of the table 60 detected by the detection unit 51 and evaluates whether pressure applied to the wafer Wa is suitable based on the contact area and a measurement value of the linear scale 34.

Next, an effect of the polishing apparatus 100 according to this embodiment will be described.

First, the table 60 is positioned along the two parallel grooves carved on the bed 70 such that the rotation center of the table 60 and the shaft center of the spindle 11 of the polishing body 10 match each other in the Y-axis direction, prior to a polishing process. The wafer Wa as the material to be polished is mounted to the table 60 such that a surface to be polished faces upward. Further, when a user activates the polishing apparatus 100, the column 21 is moved on the base 23 until the rotation center of the table 60 and the shaft center of the spindle 11 match each other in the X-axis direction of FIG. 1. At this time, the head 30 is retreated to have a sufficient height in an initial state such that the polishing pad 12 of the polishing body 10 does not interfere an edge portion of the table 60.

Further, each of the spindle 11 of the polishing body 10 and the driving mechanism of the table 60 is activated based on a command of the user, and the polishing body 10 and the table 60 are rotated at each desired speed. That is, the polishing pad 12 and the wafer Wa are rotated at each desired speed. In this state, the head 30 is moved downward together with the arm 22 by the driving mechanism provided in the column 21, and the polishing pad 12 is pushed against the wafer Wa. In this embodiment, a polishing liquid is supplied to the surface of the wafer Wa to be polished before the polishing pad 12 is pushed against the wafer Wa in order to perform the smooth polishing process.

In the polishing apparatus 100 according to this embodiment, the movement of the head 30 until the polishing pad 12 is pushed against the wafer Wa is controlled as the position control, that is, based on the position (Z coordinate) of the head 30. Further, when the target load at the time of polishing is achieved after the polishing pad 12 is pushed against the wafer Wa, it is switched to the load control based on the position (W coordinate) of the polishing body 10 with respect to the head 30 detected by the linear scale 34. In the load control according to this embodiment, the position (W coordinate) of the polishing body support member 31 is controlled on consideration of the spring constant value of the elastic mechanism 32 such that the pressure (surface pressure) applied to the contact surface between the wafer Wa and the polishing pad 12 becomes constant.

As apparent from the above description, the load control according to this embodiment is not performed by directly measuring the load applied to the polishing body 10, but is performed based on the position (W coordinate) of the polishing body 10 with respect to the head 30 that is measured by the linear scale 34. To be specific, the load applied to the polishing body 10 is evaluated based on this W coordinate and the spring constant value of the elastic mechanism 32, and the position (Z coordinate) of the head 30 is controlled such that this load becomes a predetermined value.

When the load control is started, the pressure evaluation unit 54 monitors the W coordinate of the polishing body support member 31 in real time. The polishing pad 12 gradually approaches the wafer Wa from the upper side of the wafer Wa, and at the same time, is moved from a radially outward side of the wafer Wa to a radially inward side thereof. Then, a part of the polishing pad 12 is pushed against the wafer Wa, and the polishing of the wafer Wa is started. The polishing pad 12 is gradually moved to the radially inward side of the wafer Wa. Along with this, the contact area between a polishing surface of the polishing pad 12 and the wafer Wa gradually increases, and the contact area becomes constant eventually as the entire polishing surface is brought into contact with the wafer Wa. In this embodiment, the load applied to the polishing body 10 gradually increases, and then, becomes constant since the position (Z coordinate) of the head 30 is controlled such that the pressure (surface pressure) applied to the contact surface between the polishing pad 12 and the wafer Wa becomes constant.

A thickness of the wafer Wa is decreased along with the process of polishing the wafer Wa, and the head 30 is moved downward together with the arm 22 by the driving mechanism 24 provided in the column 21 when the load applied to the polishing body 10 decreases. The polishing body 10 is strongly pushed against the wafer Wa due to such movement, and thus, the load applied to the polishing body 10 increases, and the pressing spring 32*a* is compressed. Further, the movement is stopped when the linear scale 34 detects a recovery of the W coordinate of the polishing body support member 31 registered, in advance, in the polishing apparatus 100.

At the time of polishing the wafer Wa, the polishing body 10 is linearly moved along the X coordinate direction from one peripheral edge portion to the other peripheral edge portion of the wafer Wa as the column 21 is moved on the base 23. When the polishing body 10 passes through a location where a tiny protrusion or a foreign substance is present on the surface of the wafer Wa in the course of polishing, the polishing body 10 is rapidly moved upward (pushed up).

However, the load is indirectly measured using the linear scale 34 in this embodiment, the measurable load range is wider than the case of directly measuring a load using, for example, a load cell.

Further, when desired polishing processing has been achieved, the supply of the polishing liquid is stopped, and the head 30 is moved upward together with the arm 22 by the driving mechanism 24. Further, each rotation of the polishing body 10 and the table 60 is stopped based on the user's command, and the wafer Wa is removed from the table 60. At this time, the column 21 is moved on the base 23 in the negative direction of the X coordinate of FIG. 1 if necessary, and the head 30 is retreated.

According to the above-described embodiment, the load applied to the polishing body 10 is measured without using a load cell or the like, and thus, it is possible to provide the polishing apparatus 100 capable of expanding the detection range of the load and maintaining the highly accurate polishing processing even when the polishing body 10 passes through the location where the tiny protrusion or the foreign substance is present.

Since the linear scale 34 is employed as the position sensor in this embodiment, the position sensor, it is possible to easily and accurately measure the relative position of the polishing body 10 with respect to the head 30.

Although the polishing body 10 is rotatably supported by the polishing body support member 31 via the spindle 11 in this embodiment, the polishing body 10 is not necessarily configured to be rotatably supported.

In addition, the position control is switched to the load control when the target load at the time of polishing is achieved in this embodiment, but the switching to the load control may be performed before achieving the target load. In this case, it is possible to avoid an overshoot of the load with respect to the target load caused due to a repulsive force of the elastic mechanism 32.

The invention claimed is:

1. A polishing apparatus comprising:

a holding section configured to hold a material to be polished;

a polishing body configured to polish the material to be polished held by the holding section;

a head that supports the polishing body via an elastic mechanism and a polishing body support member, the elastic mechanism including:

a pressing spring configured to press the polishing body support member against the material to be polished, and a plurality of balancing springs arranged in parallel with the pressing spring and configured to support the weight of the polishing body support member;

a driving mechanism configured to cause the head to be relatively moved with respect to the material to be polished in a direction in which a separation distance from the material to be polished is changed;

a position sensor configured to measure a position of the polishing body with respect to the head; and a control unit that is connected to the driving mechanism and that is configured to:

control the driving mechanism, calculate a load applied to the polishing body based on the position of the polishing body with respect to the head measured by the position sensor and a spring constant value of the elastic mechanism, and carry out a load control so that the load maintains a target value.

2. The polishing apparatus according to claim 1, wherein the position sensor includes a linear scale.

3. The polishing apparatus according to claim 1, wherein:

the control unit is configured to carry out position control of the driving mechanism based on the position of the head until the polishing body is pressed against the material, and the control unit is configured to change the position control into the load control when the target load is achieved.

4. The polishing apparatus according to claim 3, wherein:

the control unit includes a storing unit configured to store a Z coordinate of the polishing body support member when the position control is changed to the load control, and the control unit is configured to determine whether the polishing body support member reaches to the Z coordinate.

5. The polishing apparatus according to claim 4, wherein the control unit is configured to determine whether the load is appropriate based on a contact area of the polishing body with the material and a value measured by the position sensor.

6. The polishing apparatus according to claim 1, wherein a drive mechanism for the polishing body is built into the polishing body support member.

* * * * *